US005893476A

United States Patent [19]

Esteron

[11] Patent Number: 5,893,476

[45] Date of Patent: Apr. 13, 1999

[54] SEALING CLOSURE FOR SAMPLE TUBES

[75] Inventor: Aaron Esteron, Holon, Israel

[73] Assignee: Estar Technologies Ltd., Holon, Israel

[21] Appl. No.: 08/834,399

[22] Filed: Apr. 16, 1997

[51] Int. Cl.[6] ..... B65D 51/16

[52] U.S. Cl. ..... 215/307; 215/320; 215/355; 215/DIG. 3

[58] Field of Search ..... 215/247, 307, 215/320, 354, 355, DIG. 3

[56] References Cited

U.S. PATENT DOCUMENTS

| | | | |
|---|---|---|---|
| 456,480 | 7/1891 | Cziner . | |
| 898,564 | 9/1908 | Dougherty . | |
| 2,404,410 | 7/1946 | Smith . | |
| 2,927,709 | 7/1960 | Hoffman et al. | 215/307 X |
| 2,987,175 | 6/1961 | Bottum . | |
| 2,993,612 | 7/1961 | Trautvetter . | |
| 3,005,564 | 10/1961 | Weichselbaum . | |
| 3,118,557 | 1/1964 | Bogikes | 215/247 |
| 3,223,269 | 12/1965 | Williams . | |
| 3,335,893 | 8/1967 | Hanson . | |
| 3,510,023 | 5/1970 | Ullman et al. . | |
| 3,540,612 | 11/1970 | Brady . | |
| 3,592,349 | 7/1971 | Baugh . | |
| 3,881,626 | 5/1975 | Bartell | 215/256 |
| 3,948,261 | 4/1976 | Steiner | 215/307 X |
| 4,090,630 | 5/1978 | Wiedmer . | |
| 4,192,429 | 3/1980 | Yerman | 215/307 |
| 4,204,606 | 5/1980 | Micheli | 215/307 |
| 4,293,078 | 10/1981 | Percarpio et al. . | |
| 4,295,572 | 10/1981 | Percarpio | 215/247 |
| 4,488,656 | 12/1984 | Fukuoka et al. | 215/307 |
| 4,531,651 | 7/1985 | Donnell . | |
| 5,060,812 | 10/1991 | Ogle, II . | |
| 5,275,287 | 1/1994 | Burns . | |
| 5,288,466 | 2/1994 | Burns . | |
| 5,335,801 | 8/1994 | Lee . | |
| 5,344,036 | 9/1994 | Stanescu et al. . | |
| 5,385,253 | 1/1995 | Scharf et al. . | |
| 5,458,854 | 10/1995 | Burns . | |
| 5,498,253 | 3/1996 | Aswad et al. | 215/247 X |
| 5,552,117 | 9/1996 | Burns . | |

*Primary Examiner*—Stephen K. Cronin
*Attorney, Agent, or Firm*—Mark M. Friedman

[57] ABSTRACT

A closure for sealing a sample tube and a method for establishing vacuum conditions within the tube while the closure is loosely positioned on the tube are provided. The closure comprises: (a) an inner stopper portion for insertion into the tube; and (b) an outer skirt portion for enclosing the tube, the skirt portion including at least two radially inwardly directed extensions for loosely positioning the closure on the tube, the extensions defining at least two passageways therebetween for exchanging gases between the interior of the tube and the surrounding atmosphere when the extensions are positioned on the tube. Preferably, the inner stopper portion and the outer skirt portion are integrally made. The method comprises: (a) loosely positioning a closure on a tube, the closure including an inner stopper portion and an outer skirt portion, the outer skirt portion including at least two radially inwardly directed extensions, the extensions being positioned on the tube; (b) exchanging gases between the interior of the tube and the surrounding atmosphere through passageways formed between the extensions of the skirt portion; and (c) tightly securing the closure to the tube so as to seal the tube.

16 Claims, 3 Drawing Sheets

SEALING CLOSURE FOR SAMPLE TUBES

FIELD AND BACKGROUND OF THE INVENTION

The present invention relates to closure and method for sealing a tube and, more particularly, to highly effective sealing closure and method which enable to establish vacuum conditions within a tube while the closure is positioned on the tube.

When handling potentially contaminated physiological fluids such as blood or urine of a patient, or any other hazardous material, it is necessary to provide highly effective removable and reinsertable sealing closure for the sampling tube. Such sealing closure should preferably feature an optimal combination of structure and material so as to achieve optimal sealing properties. Further, such sealing closure should preferably enable the establishment of vacuum conditions within the sample tube, so as to allow sampling of physiological fluids by using the vacuum collection method. Further, such sealing closure should preferably enable to maintain vacuum conditions within the tube for an extended period of time, until use.

Various attempts have been made to provide sealing closures for effectively sealing a sample tube so as to maintain vacuum conditions within the tube. An example is disclosed in U.S. Pat. No. 4,531,651. However, most of these closures feature an inner stopper portion made of elastomeric material, such as butyl rubber, constructed to be received at least partially within the tube; and an outer skirt portion made of non-elastomeric material, such as plastics material, disposed radially of the stopper portion. The inner stopper portion and the outer skirt portion are usually connected to each other by means of a mechanical connection. However, closures with such a mechanical connection between the stopper portion and the skirt portion are vulnerable to separation of the two portions and therefore to deformation of the closure.

Alternatively, the stopper portion and the skirt portion are sealed to each other by means of thermoplastic elastomers which are known to have limited compression set (memory) and low resistance to deformation. Thus, such sealing connection between the inner stopper portion and the outer skirt portion may decrease the air blocking properties of the overall closure.

An example of a closure having an inner stopper portion and an outer skirt portion made as an integral unit is disclosed in U.S. Pat. No. 5,385,253. The closure is made of an elastomeric material. However, the closure disclosed is specifically adapted for the establishment of sterile conditions within the tube, while the closure is in place, i.e., securely attached to the tube. The stopper portion of such closure features extensions defining passageways through which steam can penetrate into the tube during the sterilization process. However, such closure cannot be used for maintaining vacuum conditions within the tube since any substantial pressure difference may cause penetration of air into the tube through the passageways. Further, the inclusion of extensions on the stopper portion does not provide uniform distribution of pressures on the internal facet of the tube, which uniform distribution is necessary for maintaining vacuum conditions within the tube.

Thus, none of the disclosures mentioned above provides closure having an inner stopper portion and an outer skirt portion integrally made which is specifically adapted for establishing and maintaining vacuum conditions within the tube.

Further, none of the disclosures mentioned above provides method for the establishment of vacuum conditions within the tube while the closure is loosely positioned on the tube. Rather, a special instrumentation has to be used in order to keep the closure at a predetermined position with relation to the tube while establishing vacuum conditions within the tube.

There is thus a widely recognized need for, and it would be highly advantageous to have, a closure featuring good air blocking properties, high compression set and resistance to deformation, which enables to establish and maintain vacuum conditions within a tube.

It would be further advantageous to have closure and method which enable to establish vacuum conditions within a tube while the closure is loosely positioned on the tube, thereby eliminating the need to use special instrumentation for accurately holding the closure at a predetermined position with relation to the tube while establishing vacuum conditions.

SUMMARY OF THE INVENTION

According to the present invention there is provided a closure for sealing a sample tube, comprising: (a) an inner stopper portion for insertion into the tube; (b) an outer skirt portion for enclosing the tube, the skirt portion including at least two radially inwardly directed extensions for loosely positioning the closure on the tube, the extensions defining at least two passageways therebetween for exchanging gases between the interior of the tube and the surrounding atmosphere when the extensions are positioned on the tube.

According to further features in preferred embodiments of the invention described below, the passageways are for establishing vacuum conditions within the tube while the closure is loosely positioned on the tube.

According to still further features in preferred embodiments of the invention described below, the inner stopper portion and the external skirt portion are integrally made. The closure is preferably made of an elastomeric material. The elastomeric material may be butyl rubber. Alternatively, the elastomeric material may be halogenated butyl rubber. The elastomeric material may be cross-linked, and may feature compression-set and air barrier properties equivalent to those of butyl rubber.

The closure preferably includes an upper depression for insertion of a needle or a probe. The skirt portion preferably includes a pattern on its external surface for facilitating handling of the closure.

According to another embodiment there is provided a closure for sealing a sample tube, comprising: (a) an outer skirt portion for enclosing the tube; (b) an inner stopper portion for insertion into the tube, the stopper portion including at least two radially inwardly directed depressions, the depressions forming passageways for exchanging gases between the interior of the tube and the surrounding atmosphere when the stopper portion is loosely positioned on the tube.

Preferably, the passageways are for establishing vacuum conditions within the tube while the closure is loosely positioned on the tube.

Further, according to the present invention there is provided a method for establishing pre-determined conditions within a tube, the method comprising: (a) loosely positioning a closure on a tube, the closure including an inner stopper portion and an outer skirt portion, the outer skirt portion including at least two radially inwardly directed extensions, the extensions being positioned on the tube; (b) exchanging gases between the interior of the tube and the surrounding atmosphere through passageways formed between the extensions of the skirt portion; and (c) tightly securing the closure to the tube so as to seal the tube.

According to another embodiment, the method comprises: (a) loosely positioning a closure on a tube, the closure including an inner stopper portion and an outer skirt portion, the inner stopper portion including at least two radially inwardly directed depressions, the stopper portion being loosely positioned on the tube; (b) exchanging gases between the interior of the tube and the surrounding atmosphere through passageways formed by the depressions of the stopper portion; and (c) tightly securing the closure to the tube so as to seal the tube.

Further, according to the present invention there is provided a method for establishing vacuum conditions within a tube, comprising: (a) loosely positioning a closure on a tube, the closure including an inner stopper portion and an outer skirt portion, the outer skirt portion including at least two radially inwardly directed extensions, the extensions being positioned on the tube; (b) establishing vacuum conditions within the tube by means of passageways formed between the extensions of the skirt portion; and (c) tightly securing the closure to the tube so as to maintain the vacuum conditions within the tube.

According to another embodiment, the method comprises: (a) loosely positioning a closure on a tube, the closure including an inner stopper portion and an outer skirt portion, the inner stopper portion including at least two radially inwardly directed depressions, the stopper portion being loosely positioned on the tube; (b) establishing vacuum conditions within the tube by means of passageways formed by the depressions of the stopper portion; (c) tightly securing the closure to the tube so as to maintain the vacuum conditions within the tube.

The present invention successfully addresses the shortcomings of the presently known configurations by providing a sealing closure featuring good air blocking properties, high compression set and resistance to deformation, which enables to establish vacuum conditions within a tube and to maintain such vacuum conditions for an extended period of time (several years).

Further, the present invention addresses the shortcomings of the presently known configurations by providing closure and method which enable to establish vacuum conditions within a tube while the closure is loosely positioned on the tube, thereby eliminating the need to use special instrumentation for accurately holding the closure at a predetermined position with relation to the tube while establishing vacuum conditions.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a sealing closure having good air blocking properties, high compression set and resistance to deformation, which enables the establishment of vacuum conditions within a tube.

Further, the present invention is of a method for establishing vacuum conditions within a tube while the closure is loosely positioned on the tube, the method eliminating the need to use special instrumentation for keeping the closure at a predetermined position with relation to the tube while establishing vacuum conditions.

The principles and operation of sealing closure and method according to the present invention may be better understood with reference to the drawings and the accompanying description.

Figure 1A:
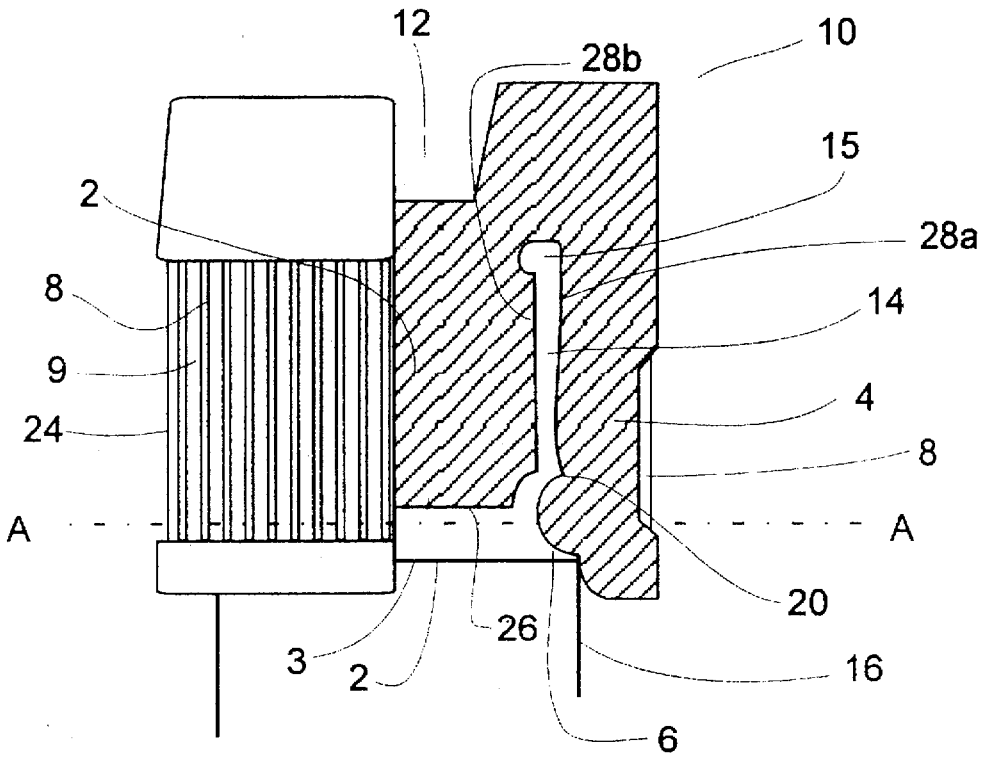
FIG. 1*a* is a side view, partially in longitudinal section, of a sealing closure according to the present invention.
Figure 1B:
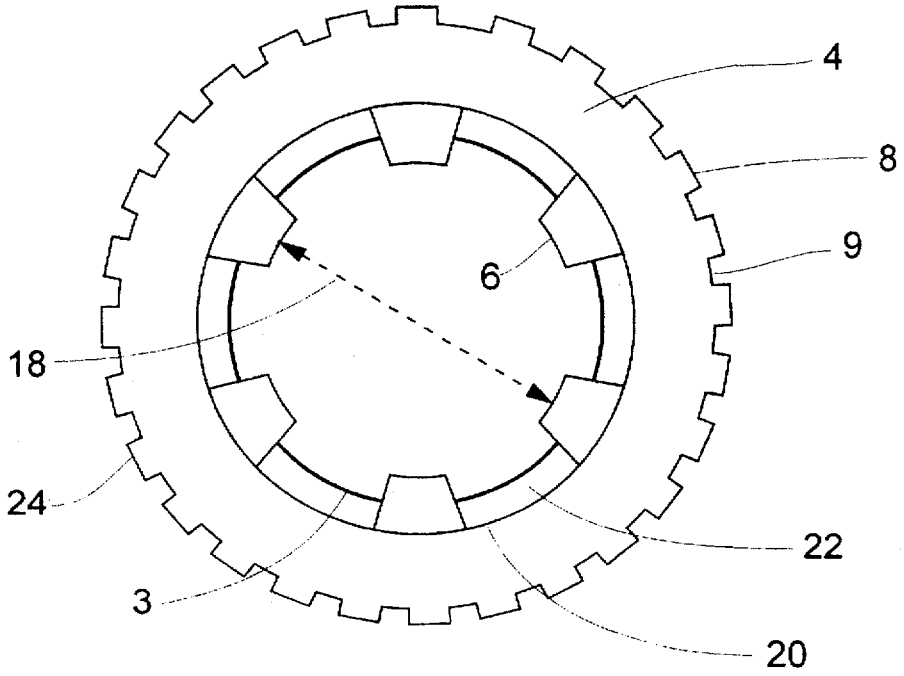
FIG. 1*b* is a transverse sectional view along line A—A in FIG. 1*a*.

Referring now to the drawings, FIGS. 1*a* and 1*b* illustrate a sealing closure 10 according to the present invention. As shown in the figures, closure 10 includes an inner stopper portion 2 for insertion into an opening of a tube 16, and an outer skirt portion 4 disposed radially of stopper portion 2 for enclosing tube 16. Stopper portion 2 and skirt portion 4 defines a cylindrical recess 14 for receiving the tube therein.

Recess 14 preferably includes a groove 15 at its upper portion for receiving the upper edge 3 of tube 16. The dimensions of groove 15 are designed to provide maximal sealing of upper edge 3.

Closure 10 preferably features an upper depression 12 for receiving a needle therein when sampling physiological fluid using the vacuum collection method. Further, the dimensions of depression 12 are preferably adapted for the insertion of conventional probes of automatic instrumentation which are used to analyze the physiological fluid following collection. Depression 12 decreases the thickness of stopper portion 2 through which the needle or the probe are inserted. Thus, stopper portion 2 preferably allows the insertion of very short needles and probes.

Further, the dimensions of upper depression 12 are designed to minimize the risk of contamination due to leakage of the physiological fluid following the extraction of the needle from closure 10. Thus, upper depression 12 preferably features a substantial cylindrical funnel-like shape which is narrow and deep enough so as to prevent potential hand contact with the bottom of depression 12.

Skirt portion 4 preferably features at least two radially inwardly directed extensions 6. The diameter 18 of the circle defined by extensions 6 is preferably smaller than the diameter of upper edge 3 of tube 16. (FIG. 1*b*). Thus, closure 10 may be loosely positioned on tube 16 such that extensions 6 are being supported by upper edge 3 (as shown in FIG. 1*a*). Further, the diameter of the inner wall 20 of skirt portion 4 adjacent extensions 6 is preferably greater than the diameter of upper edge 3. Thus, when closure 10 is loosely positioned on tube 16 by means of extensions 6, passageways 22 are established, which enable fluid communication between the interior of tube 16 and the outer surrounding atmosphere. Thus, vacuum conditions, for example, may be established within tube 16 while closure 10 is loosely positioned on the tube. Such method for the establishment of vacuum conditions within the tube eliminates the need to use expensive and cumbersome instrumentation for accurately keeping the closure at a predetermined position with relation to the tube during vacuum establishment.

After vacuum conditions have been established, closure 10 is tightly secured to tube 16. The upper portions 28*a* and 28*b* of closure 10 provide highly effective sealing since they produce homogeneous distribution of pressures on the internal facet and the external facet of tube 16, thereby enabling to maintain vacuum conditions within the tube. Since extensions 6 are located at the lower portion of skirt portion 4, they do not interfere with the sealing quality.

Closure 10 is preferably made of an elastomeric material such as: butyl rubber; halogenated butyl rubber such as brominated butyl rubber; or any other elastomer which is relatively good air barrier and which features the property of good compression set (memory). The elastomeric material may be cross-linked.

Preferably, stopper portion 2 and skirt portion 4 are integrally formed in a process of compression molding, transfer molding, or injection molding.

The outer wall 24 of skirt portion 4 preferably features a pattern of longitudinal extensions 8 and longitudinal depressions 9 so as to facilitate handling of the closure when using wet gloves.

As shown in the figure, skirt portion 4 preferably extends beyond the lower edge 26 of stopper portion 2 so as to minimize the risk of contamination when handling the closure.

Figure 2:
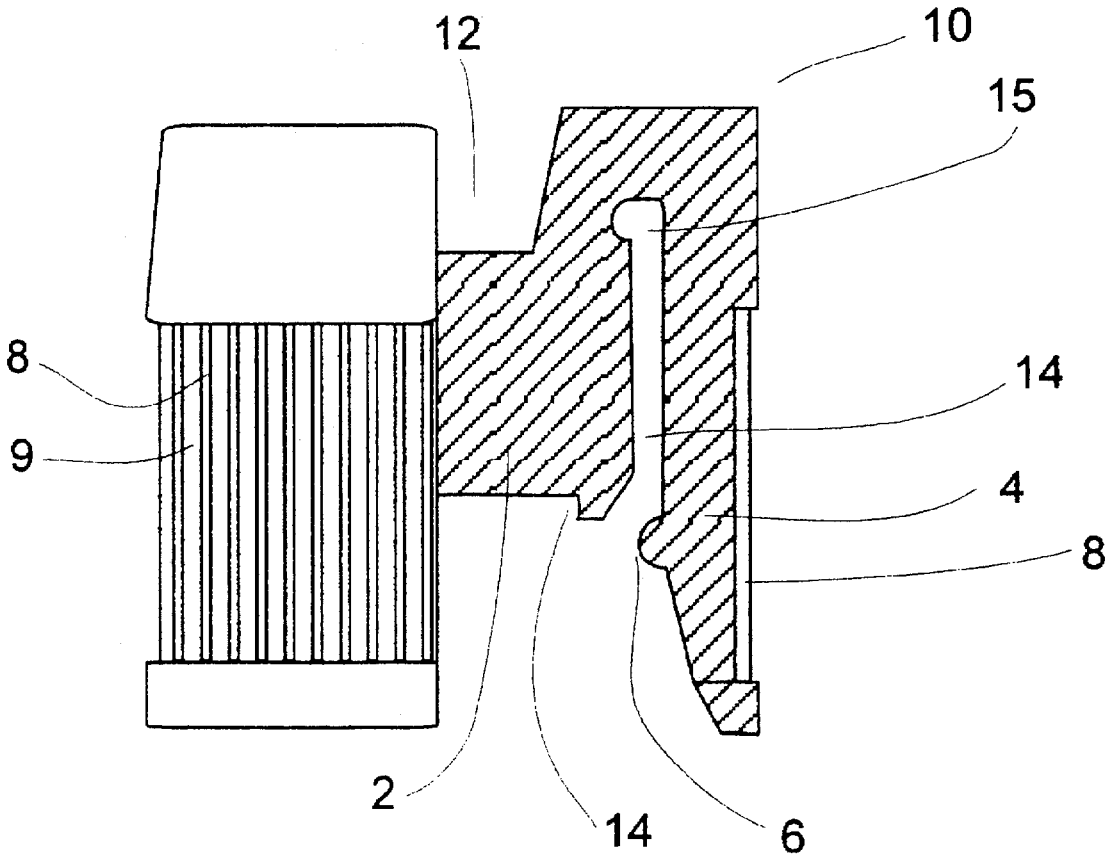
FIG. 2 is a side view, partially in longitudinal section, of another embodiment of a sealing closure according to the present invention.

Referring now to FIG. 2, according to another embodiment stopper portion 2 features a lower depression 14. Such configuration enables the insertion of very short needles and probes.

Figure 3A:
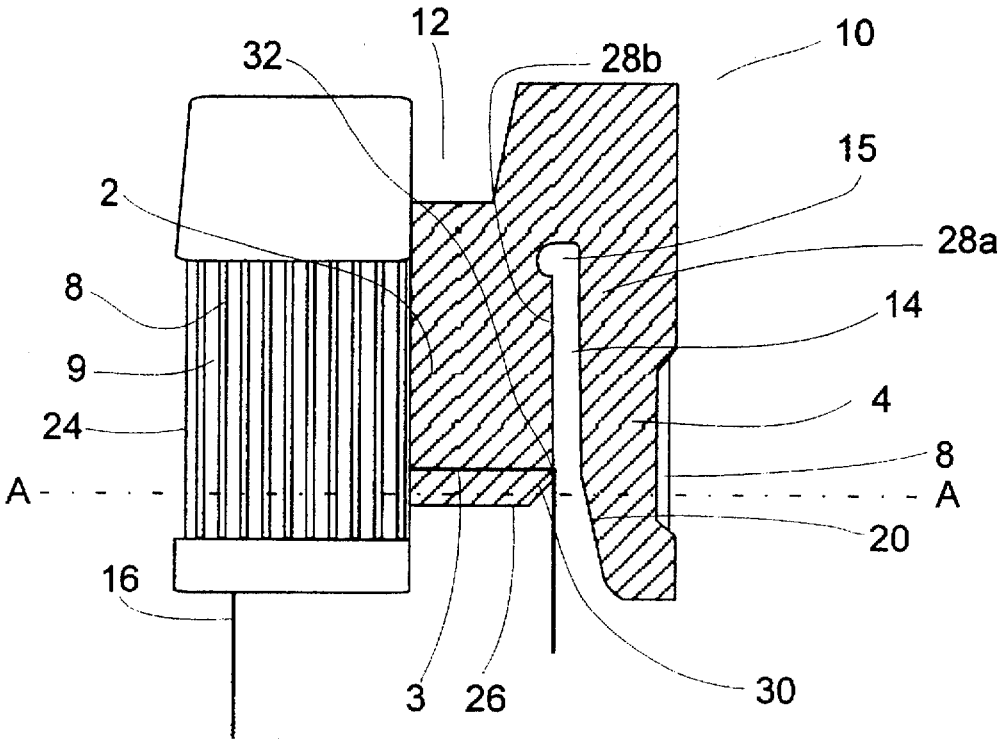
FIG. 3*a* is a side view, partially in longitudinal section, of another embodiment of a sealing closure according to the present invention.
Figure 3B:
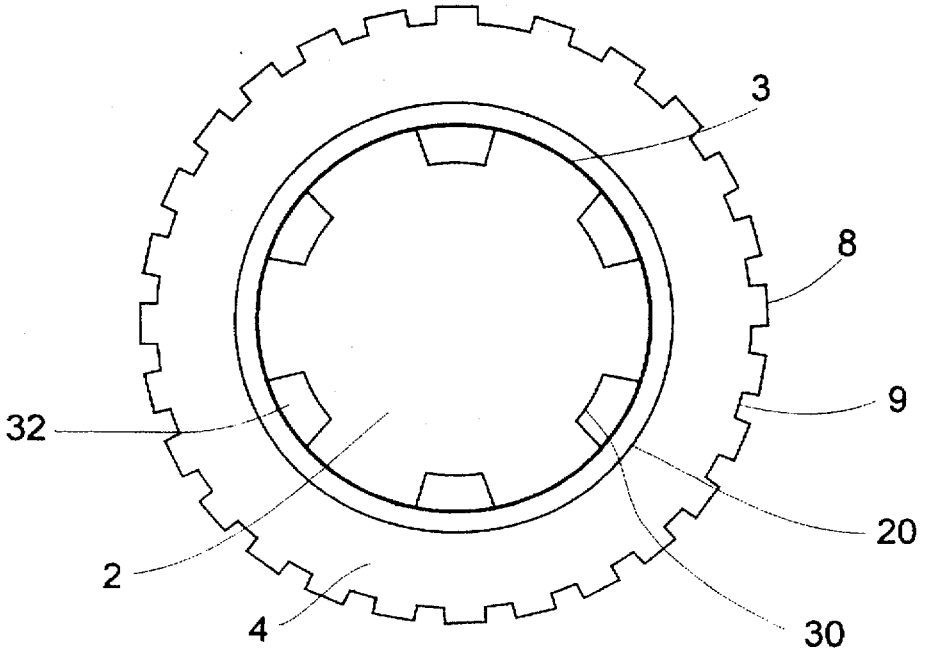
FIG. 3*b* is a transverse sectional view along line A—A in FIG. 3*a;*

Referring now to FIGS. 3*a* and 3*b*, according to another embodiment stopper portion 2 features at least two radially inwardly directed depressions 30 forming passageways 32 for allowing the establishment of vacuum conditions within the tube while closure 10 is loosely positioned on the tube.

Referring now to FIGS. 1*a* and 1*b*, when using closure and method according to the present invention, closure 10 is positioned on tube 16 such that extensions 6 are supported by upper edge 3 and passageways 22 are defined which allow fluid communication between the internal portion of tube 16 and the outer surrounding atmosphere. A desired level of vacuum is then established within tube 16.

Following the establishment of the desired level of vacuum within tube 16, closure 10 is securely attached to the tube. Thus, vacuum conditions within tube 16 are maintained until use. Such vacuum conditions can be maintained for extended periods (several years).

When sampling physiological fluids such as blood or urine by using a conventional vacuum collection method, a conventional needle is inserted into upper depression 12 until the needle penetrates through the thickness of stopper portion 2. The physiological fluid is then collected into tube 16 according to the level of vacuum established within the tube.

While the invention has been described with respect to a limited number of embodiments, it will be appreciated that many variations, modifications and other applications of the invention may be made.

What is claimed is:

1. A combination of a closure and a sample tube, said sample tube comprising having a sidewall and an upper edge said closure for sealing said sample tube comprising:

(a) an inner stopper portion for insertion into the tube;

(b) an outer skirt portion for enclosing the tube, said skirt portion including at least two radially inwardly directed extensions for loosely positioning said closure on the tube, said extensions defining at least two passageways therbetween for exchanging gases between the interior of the tube and the surrounding atmosphere when said extensions are positioned on the upper edge of the tube.

2. The closure of claim 1, wherein said inner stopper portion and said external skirt portion are integrally made.

3. The closure of claim 2, wherein said closure is made of an elastomeric material.

4. The closure of claim 3, wherein said elastomeric material is butyl rubber.

5. The closure of claim 3, wherein said elastomeric material is halogenated butyl rubber.

6. The closure of claim 3, wherein said elastomeric material is cross-linked and features compression set and air barrier properties equivalent to those of butyl rubber.

7. The closure of claim 1, wherein said skirt portion includes a pattern on its external surface for facilitating handling of the closure.

8. The closure of claim 1, wherein said closure includes an upper depression for insertion of a needle.

9. A combination of a closure and a sample tube, said sample tube comprising having a sidewall and an upper edge;

said closure for sealing said sample tube, comprising:

(a) an inner stopper portion for insertion into the tube;

(b) an outer skirt portion for enclosing the tube, said skirt portion including at least two radially inwardly directed extensions for loosely positioning said closure on the tube, said extensions defining at least two passageways therebetween for establishing vacuum conditions within the tube when said extensions are positioned on the upper edge of the tube.

10. The closure of claim 9, wherein said inner stopper portion and said external skirt portion are integrally made.

11. The closure of claim 9, wherein said closure is made of an elastomeric material.

12. The closure of claim 9, wherein said elastomeric material is butyl rubber.

13. The closure of claim 9, wherein said elastomeric material is halogenated butyl rubber.

14. The closure of claim 9, wherein said elastomeric material is cross-linked and features compression set and air barrier properties equivalent to those of butyl rubber.

15. A method for establishing pre-determined conditions within a tube having a sidewall and an upper edge, comprising:

(a) loosely positioning a closure on the tube, said closure including an inner stopper portion and an outer skirt portion, said outer skirt portion including at least two radially inwardly directed extensions, said extensions being positioned on the upper edge of the tube;

(b) exchanging gases between the interior of the tube and the surrounding atmosphere through passageways formed between said extensions of said skirt portion; and (c) tightly securing said closure to the tube so as to seal the tube.

16. A method for establishing vacuum conditions within a tube having a sidewall and an upper edge, comprising:

(a) loosely positioning a closure on the tube, said closure including an inner stopper portion and an outer skirt portion, said outer skirt portion including at least two radially inwardly directed extensions, said extensions being positioned on the upper edge of the tube;

(b) establishing vacuum conditions within the tube by means of passageways formed between said extensions of said skirt portion; and (c) tightly securing said closure to the tube so as to maintain the vacuum conditions within the tube.

* * * * *